United States Patent [19]

Galvin

[11] Patent Number: 4,872,688

[45] Date of Patent: Oct. 10, 1989

[54] DISC LAUNCHING AND CATCHING APPARATUS

[76] Inventor: Irving H. Galvin, 18895 SW. 84 Rd. Pl., Bldg. 12-#14, Miami, Fla. 33157

[21] Appl. No.: 315,644

[22] Filed: Feb. 27, 1989

[51] Int. Cl.[4] ..... A63B 65/10

[52] U.S. Cl. ..... 273/326; 124/5

[58] Field of Search ..... 273/326, 322, 323, 324, 273/325; 124/5

[56] References Cited

U.S. PATENT DOCUMENTS

| | | | |
|---|---|---|---|
| 2,124,738 | 7/1938 | Johnsen | 124/5 |
| 2,493,245 | 1/1950 | Hansen | 124/5 |
| 2,586,547 | 2/1952 | Marley | 124/5 |
| 3,185,479 | 5/1965 | Ortega | 273/322 |
| 3,711,096 | 1/1973 | Cramp et al. | 273/318 |
| 4,045,027 | 8/1977 | Manska | 273/322 |
| 4,145,050 | 3/1979 | Sullivan et al. | 273/322 |
| 4,157,828 | 6/1979 | Cosmopulos | 273/325 |
| 4,277,068 | 7/1981 | Sasaki | 273/324 |
| 4,752,076 | 6/1988 | Gelinas, Jr. | 273/318 |

*Primary Examiner*—William H. Grieb

*Attorney, Agent, or Firm*—Henderson & Sturm

[57] ABSTRACT

A disc launching and catching apparatus (10) for use with an aerodynamic disc (100) wherein the apparatus (10) comprises a scoop member (14) having generally flexible opposed side wall portions (17) which are controlled by a pair of spaced handle members (19) which may be compressed together to overcome the biasing force of a spring member (21) to bring the opposed side wall portions (17) of the scoop member (14) into frictional engagement with the sides of an aerodynamic disc.

5 Claims, 1 Drawing Sheet

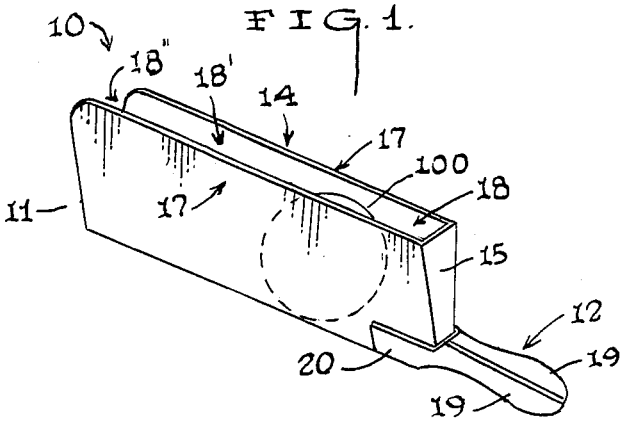
FIG. 1.
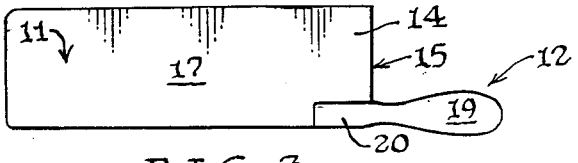
FIG. 3.
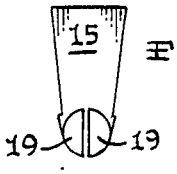
FIG. 4.
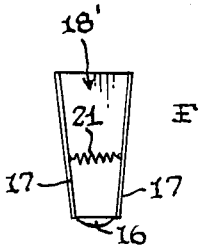
FIG. 5.
FIG. 2.
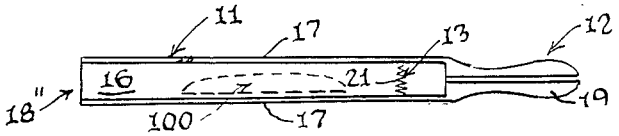
FIG. 6.
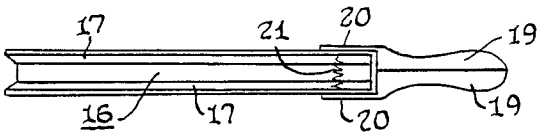

DISC LAUNCHING AND CATCHING APPARATUS

TECHNICAL FIELD

The present invention relates generally to the field of object launching and catching apparatus, and more particularly to a launching and catching apparatus for aerodynamic discs.

BACKGROUND OF THE INVENTION

The present invention was the subject matter of Document Disclosure Program Registration No. 200173 which was filed in the U.S. Patent and Trademark office on Aug. 31, 1988.

As can be seen by reference to the following U.S. Patent No's: 3,185,479; 3,711,096; 4,752,076; and, 4,045,027 the prior art is replete with myriad and diverse apparatus for launching and catching diverse objects.

While all of the aforementioned prior art constructions are more than adequate for the general purpose for which they have been specifically designed, with the exception of the '096 patent, all of the above cited prior art patents are designed specifically to launch, catch and/or redirect the flight of a spherical member such as a ball or the like.

With regard to the '096 patent this invention was designed to be used in conjunction with non-spherical member having a reduced diameter intermediate portion that is intended to be grasped in a scissors like movement of the pivoted capture arms of the device.

In light of the foregoing state of the art in this field of technology and given the widespread popularity of aerodynamic discs such as FRISBEE and the like; it comes as somewhat of a surprise that to date no one has developed a launching and catching apparatus that is specifically designed to be employed in conjunction with an aerodynamic disc or similar object.

SUMMARY OF THE INVENTION

Briefly stated, the disc launching and catching apparatus that forms the basis of the present invention comprises: a capture and release unit; a handle unit; and a spring biasing unit.

The capture and release unit comprises in general: an elongated relatively narrow scoop member having an open end and a closed end wherein the walls of the scoop member are generally flexible so as to allow the capture and release of a disc disposed intermediate the walls of the scoop member.

The handle unit comprises a pair of handle members wherein each handle member is operatively attached to one side of the scoop member; and wherein movement of the handle members will be translated directly to the opposed walls of the scoop member.

The spring biasing unit comprises a spring member disposed intermediate the walls of the scoop member for biasing the mouth of the scoop member into a normally biased open disposition; wherein, the handle members may be used to overcome the biasing effect of the spring member to bring the walls of the scoop member into frictional engagement with the sides of an aerodynamic disc.

BRIEF DESCRIPTION OF THE DRAWINGS

These and other objects, advantages and novel features of the invention will become apparent from the detailed description of the best mode for carrying out the preferred embodiment of the invention which follows; particularly when considered in conjunction with the accompanying drawings; wherein:

FIG. 1 is a perspective view showing the apparatus in an open mouthed configuration;

FIG. 2 is a top plan view showing the apparatus in an open mouthed configuration;

FIG. 3 is a side plan view;

FIG. 4 is a rear end plan view;

FIG. 5 is a front end plan view; and,

FIG. 6 is a top plan view showing the apparatus in a closed mouth configuration.

BEST MODE FOR CARRYING OUT THE INVENTION

As can be seen by reference to the drawings and in particular to FIGS. 1 and 2, the disc catching and launching apparatus that forms the basis of the present invention is designated generally by the reference numeral (10). The apparatus (10) comprises in general: a capture and release unit (11); a handle unit (12); and, a spring biasing unit (13). These units will now be described in seriatim fashion.

As shown in FIGS. 1 thru 5, the capture and release unit (11) comprises a generally elongated, narrow scoop member (14) having a rear wall portion (15); a floor portion (16) and a pair of opposed generally flexible side wall portions (17) which define a scoop mouth opening (18) having upper (18') and front (18'') mouth openings.

As can best be seen by reference to FIGS. 2, 4 and 6, the handle unit (11) comprises a pair of spaced handle members (19) wherein each handle member (19) has an inboard end (20) which is operatively attached to one of the opposed side wall portions (17) of the scoop member (14).

Turning now to FIGS. 2, 5 and 6 it can be seen that the spring biasing unit (13) comprises a spring member (21) disposed intermediate the opposed side wall portions (17) at a location proximate to the rear wall portion (15) of the scoop member (14); such that the side wall portions (17) and their associated handle members (19) are normally biased away from one another.

It should also be appreciated at this juncture that the scoop member (14) is fabricated from generally flexible material such as plastic or the like that will allow the opposed wall portions (17) of the scoop member (14) to be flexed towards one another by overcoming the spring biasing unit (13) through a compressive force applied by the user upon the handle members (19).

When the user wishes to captively engage an aerodynamic disc (100) within the apparatus (10) all that is required is for the user to tightly grasp the handles (19) to bring the wall portions (17) into engagement with the sides of an aerodynamic disc (100). Then when it is desired to release the disc (100) the users grasp on the handle members (19) is relaxed to allow the spring member (21) to return the opposed side walls (17) to return to the open mouthed orientation depicted in FIG. 6.

Having thereby described the subject matter of this invention it should be apparent that many substitutions, modifications and variations of the invention are possible in light of the above teachings. It is therefore to be understood that the invention as taught and described herein is only to be limited to the extent of the breadth and scope of the appended claims.

I claim:

1. A disc catching and launching apparatus for use in combination with an aerodynamic disc wherein the apparatus comprises:

a catching and release unit including a generally elongated narrow scoop member having opposed generally flexible side wall portions which define the scoop mouth opening;

a handle unit comprising a pair of spaced handle members wherein each handle member is provided with an inboard end which is operatively attached to one of the said side wall portions of the said scoop member.

2. The apparatus as in claim 1 further comprising:

a spring biasing unit operatively associated with said scoop member for biasing the mouth opening of the scoop member into a normally open disposition.

3. The apparatus as in claim 2 wherein the scoop member further includes:

a rear wall portion; and, a floor portion.

4. The apparatus as in claim 3 wherein the spring biasing unit comprises:

a spring member disposed intermediate the opposed side wall portions of said scoop member.

5. The apparatus as in claim 4 wherein the spring member is located proximate to the rear wall portion ofsaid scoop member.

* * * * *